US006800034B2

(12) United States Patent
Burkholder

(10) Patent No.: US 6,800,034 B2
(45) Date of Patent: Oct. 5, 2004

(54) GOLF PUTTING/CHIPPING INSTRUCTIONAL DEVICE AND METHOD OF USE

(76) Inventor: John Burkholder, 27552 Berdun, Mission Viejo, CA (US) 92691

( * ) Notice: Subject to any disclaimer, the term of this patent is extended or adjusted under 35 U.S.C. 154(b) by 0 days.

(21) Appl. No.: 10/289,735

(22) Filed: Nov. 7, 2002

(65) Prior Publication Data

US 2004/0092324 A1 May 13, 2004

(51) Int. Cl.[7] ..... A63B 69/36
(52) U.S. Cl. ..... 473/174
(58) Field of Search ..... 473/174–189

(56) References Cited

U.S. PATENT DOCUMENTS

| | | | | | |
|---|---|---|---|---|---|
| 1,094,236 | A | * | 4/1914 | Minshall | 473/180 |
| 1,693,474 | A | * | 11/1928 | Burt | 473/185 |
| 2,459,559 | A | * | 1/1949 | Watkins | 473/180 |
| 3,559,997 | A | * | 2/1971 | Hitch | 473/189 |
| 3,659,856 | A | * | 5/1972 | Fatur | 473/180 |
| 5,074,565 | A | | 12/1991 | Tucker | |
| D331,438 | S | | 12/1992 | Tucker | |
| 5,205,559 | A | * | 4/1993 | Plopper | 473/179 |
| 5,324,039 | A | * | 6/1994 | Reimers et al. | 473/180 |
| 5,645,492 | A | * | 7/1997 | Anderson | 473/185 |
| 5,692,963 | A | * | 12/1997 | Holcombe | 473/162 |
| 6,183,373 | B1 | * | 2/2001 | Falvo | 473/180 |
| 6,482,098 | B1 | * | 11/2002 | Yates | 473/185 |
| 2002/0173366 | A1 | * | 11/2002 | Lister | 473/174 |

* cited by examiner

*Primary Examiner*—Mark S. Graham
(74) *Attorney, Agent, or Firm*—Stetina Brunda Garred & Brucker

(57) ABSTRACT

The present invention relates to a golf instructional device for assisting a golfer to putt/chip a golf ball to a golf hole. The device includes a substantially rigid body formed to visually identify a point of entry adjacent the golf hole and a breaking point on a line of travel. The body may define an intermediate guideline member having a generally u-shaped configuration formed to surround at least a portion of the golf hole, and elongated first and second guideline members extending from a portion of the intermediate guideline member which define first and second boundaries for the point of entry respectively. At least a portion of the intermediate guideline member is positionable adjacent the golf hole and rotatable thereabout so as to allow the first and second guideline members to collectively define the first and second boundaries for the point of entry and for identifying the breaking point.

21 Claims, 2 Drawing Sheets

10
12
14
16
18
20
22
24
26
28
29
30
36
38
40
42
44
46
48
54
5
6
α
D 40
42
40
10
36
32
34
40
40
44

D1
46
-24-
10
14
28
16
54
29
18
50
52
20
26

D2
46
-18-
10
14
28
16
54
29
18
50
52
20
26

D3
46
10
-12-
14
28
16
54
29
18
50
52
20
26

GOLF PUTTING/CHIPPING INSTRUCTIONAL DEVICE AND METHOD OF USE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to the field of golf instructional devices and more particularly to instructional devices for assisting a user to visually perceive the optimum point of entry into a golf hole and to further identify the breaking point between a target line and a line of travel when putting/chipping golf balls.

Golf is a very popular sport which requires an extraordinary amount of training, skill, and precise timing gained through substantial experience. To learn golf, a prospective golf player typically takes a series of lessons from a professional who can properly instruct the player on the correct swing. Generally, the instructors teach golfers the proper form of a golf swing and correct their subtle errors in an attempt to perfect their swing. These lessons help the player fine tune their ability to accurately drive the golf ball desired distances using drivers, irons or woods. However, a successful golf game is also dictated by the use of wedges and putters. It is estimated that on a typical par 72 course, putting accounts for almost fifty percent of all shots taken while the remaining fifty percent of shots are taken using irons, woods, and wedges. As experienced golfers may recognize, having proper putting technique and skills can dramatically change a golfer's game and can make the difference between winning and losing a golf game.

As golf instructors understand, one of the best ways to improve putting skill is through kinesthetic learning. Adjusting the amount of force necessary to propel a golf ball a desired distance and fine-tuning the relative arm-motions may be practiced repeatedly so as to build a subconscious memory of the particular combinations of each factor when putting/chipping. In golf instruction, teaching a golfer the correct golf swing may assist a golfer in obtaining the proper distance and speed to reach the hole. However, one of the most difficult aspects of putting and chipping is the skill of adjusting the golf swing speed and angle to account for the slope of a green. More specifically, a golfer must visually identify a target line which the golfer actually hits the ball along, the breaking point where the ball deviates from the target line due to the slope of the green, the line on which the golf ball will actually travel, and the golf ball's point of entry into the hole. It is through an understanding of each of these that a golfer may successfully putt/chip a ball into a golf hole. In doing so, the golfer must essentially approximate the slope angle, the distance, and the speed which is necessary to hit the ball into the hole. Extensively practicing a golf swing might improve speed and distance control, but aiming and accommodating speed and distance control based on the slope angle requires more visual perception and experience than swing technique.

For example, in the simplest scenario, a golfer may be presented with having to putt/chip to a golf hole on a substantially flat green. In this case, the target line and the ball line should be the same and there would be no breaking point since the ball should merely travel in a straight line to the golf hole. Additionally, the point of entry is generally predictable by the golfer and it is easy to identify that the point of entry substantially coincides with the target line. However, as is more typical in golfing, the greens are generally sloped in one direction or another. In addition, some greens have undulations or other imperfections in the grass which may cause the ball to drift into an unintended direction if undiscovered by the golfer during surveying. Thus, to successfully putt/chip a ball into the golf hole, the golfer must initially survey the green and establish the direction and severity of the green's slope. Some golfers engage in what is known as "plumb bobbing" whereby the golfer stands substantially close to the ground and holds the putter shaft vertical while facing the golf hole to establish the slope of the green. The vertical shaft provides a reference line by which the golfer may judge the severity of the slope. Once the slope of the green is established, the golfer must then determine where the target line should be. Some golfers may accomplish this by imagining a point several feet in front of their ball while others picture an imaginary line. Generally, the target line is selected while also imagining the line of travel and establishing where the ball might deviate from the target line at its breaking point. Depending upon the severity of the slope, the line of travel may generally be straight and substantially coincide with the target line until the ball begins to curve and otherwise deviate from the target line at the breaking point. Additionally, depending upon the severity of the slope, the golf ball's actual point of entry may be even more difficult to predict since the ball may break more severely or less severely than expected. It is this crucial point of entry that golfers have the most difficulty visualizing since it is largely dependant upon visualizing the line of travel and understanding that the golf ball will generally lose speed as it gets closer to the golf hole.

While most golfers may have a general idea as to where the target line, breaking point, ball line, and point of entry might be, the reality is that almost ninety percent of golfers tend to miss their putts on the "low side" of the break. In this respect, golfers may incorrectly perceive the breaking point, the line of travel, and the point of entry by deciding upon a target line which allows the golf ball to break too early and curve before the golf hole. Professional golfers who are more experienced in compensating for such factors are by no means perfect either. Even though professional golfers may be better at compensating for the slope of a green, they are ultimately relying upon the same skill of visualizing the target line, breaking point, line of travel, and point of entry as an amateur golfer would. Accordingly, there is a need for an instructional device which allows golfers of all skill levels to visualize the line of travel, the breaking point and target line during putting and chipping.

Prior art devices exist for allowing a golfer to improve their swing when using a long-distance driver, iron, wood golf club or even the putter. In fact, some devices even guide golfers during their putting swing to assist with the desired pendulum-like motion associated therewith. However, as understood, none of the prior art devices assist golfers in visually identifying the line of travel, breaking point, target line, and point of entry during putting and chipping.

BRIEF SUMMARY OF THE INVENTION

The present invention specifically addresses and alleviates the above-identified deficiencies in the art. In this regard, the present invention assists golfers by allowing an instructor, or student golfer, to focus attention upon the optimum breaking point between the target line and the line of travel, and the ultimate point of entry into the golf hole. Such focus is particularly directed to approximate and visualize the area where the ball has the best chance to enter the golf hole. More specifically, by fabricating a golf instructional device in accordance with the present invention, a golfer may place the device adjacent the golf hole and rotate the device thereabout depending upon the approximate slope angle of the green. In this respect, the device allows the golfer to more accurately visualize the point of entry and estimate a club swing speed necessary for the ball to travel along a selected target line and break therefrom at a breaking point toward the golf hole along the line of travel.

In accordance with the present invention, there is provided a golf instructional device for assisting a golfer to putt/chip a golf ball to a golf hole. The device includes a substantially rigid body formed to visually identify point of entry adjacent the golf hole and a breaking point on a line of travel. The body defines an intermediate guide portion having a generally u-shaped configuration formed to surround at least a portion of the golf hole. The body also defines an elongated first guideline member extending from a portion of the intermediate guideline member, the first guideline member defining a first boundary for the point of entry. Additionally, an elongated second guideline member extending from a portion of the intermediate guideline member is defined by the body. The second guideline member defines a second boundary for the point of entry. At least a portion of the intermediate guideline member is positionable adjacent the golf hole and rotatable thereabout such that the first and second guideline members collectively define the first and second boundaries for the point of entry therebetween and further identify the breaking point.

To allow the golfer to understand that there is essentially a margin of error in putting or chipping the golf ball to the golf hole, boundaries may be defined to show how much error is allowed in putting the golf ball to the hole. These boundaries may be communicated to the golfer by placing the device adjacent the golf hole and pointing the guideline members toward the direction of the boundaries. Additionally, the forming of the boundaries clarifies to the golfer where the proper point of entry is which will allow the golf ball to fall into the golf hole. It has been discovered that such point of entry defined by the boundaries, if followed by the golfer, yields positive results with little or no missed shots. Various sizes and shapes of the device may be fabricated to be utilized for varying degrees of breaks. In addition, a single device may be fabricated which allows the golfer to adjust the curvature of the device depending upon the degree of break. Such adjustments may be made by providing for retractable guideline members which are shapeable and/or extendable.

Advantageously, the device may be flipped between its planar surfaces to allow a golfer to utilize the device as an aid from any angle that golfer is approaching from, which depends upon the slope angle of the green. Additionally, to prevent slippage or other undesirable movements of the device when placed into position adjacent the golf hole, mounting members may be inserted through the device and into the green to prevent environmental conditions, such as wind, from causing misalignment of the device.

Therefore, it is one of the objects of the invention to provide a golf instructional device which allows golfers to visualize the ultimate point of entry and a breaking point.

It is also an object of the invention to provide a method of positioning a golf instructional device adjacent a golf hole to allow the golfer to visualize the ultimate point of entry and the breaking point.

BRIEF DESCRIPTION OF THE DRAWINGS

These as well as other features of the present invention will become more apparent upon reference to the drawings wherein.

DETAILED DESCRIPTION OF THE INVENTION

The detailed description, as set forth below in connection with the appended drawings, is intended as a description of the presently preferred embodiments of the invention, and is not intended to represent the only form in which the present invention may be constructed or utilized.

Figures 1, 2, 3, 4:
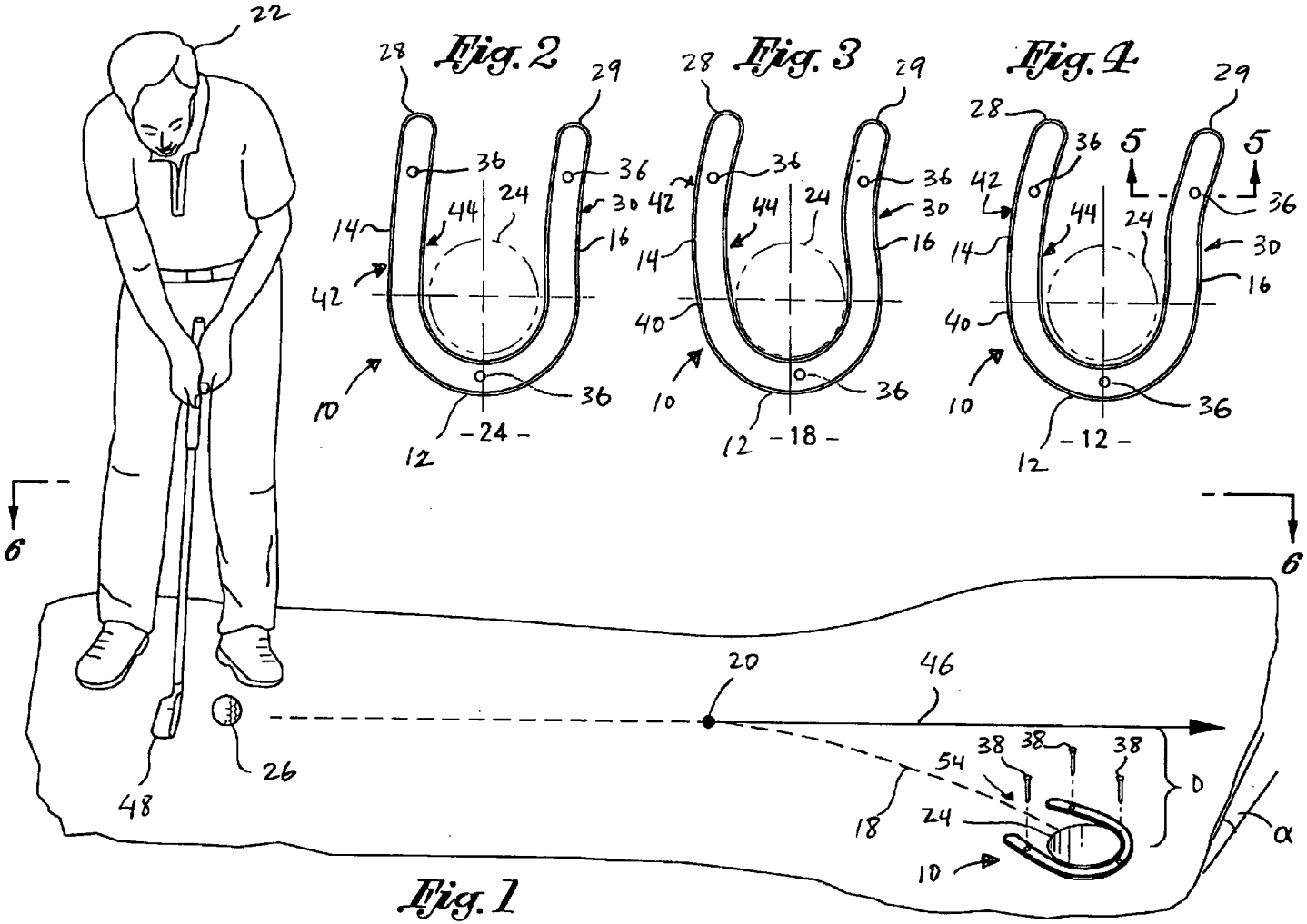
FIG. 1 is a perspective view illustrating the instructional device placed adjacent a golf hole on a sloped surface.
FIG. 2 is a plan view of a first embodiment of the present invention wherein the first and second guideline members are defined by a circle of curvature having a radius of 12 inches.
FIG. 3 is a plan view of a second embodiment of the present invention wherein the first and second guideline members are defined by a circle of curvature having a radius of 18 inches.
FIG. 4 is a plan view of a third embodiment of the present invention wherein the first and second guideline members are defined by a circle of curvature having a radius of 24 inches.

Referring now to the drawings wherein the showings are for the purposes of illustrating preferred embodiments of the present invention only, and not for the purposes of limiting the same, FIG. 1 shows a first embodiment of the present invention showing the golf instructional device having a substantially rigid body 10 placed adjacent a golf hole 24. Preferably, the body should be fabricated from a plastic material such as ABS plastic. However, other materials which provide rigidity may be utilized such as steel, aluminum, or even cardboard. As described herein, rigidity refers to the material's quality of being resistant to flexion and breakage from pressure placed upon the body 10. As more particularly shown in FIGS. 2–4, the body 10 may be formed having an intermediate guideline member 12 having a generally u-shaped configuration formed to surround at least a portion of the golf hole 24. Additionally, the body 10 further defines an elongated first guideline member 14 extending from a portion of the intermediate guideline member 12. The body 10 further defines an elongated second guideline member 16 extending from a portion fo the intermediate guideline member 12. Preferably, the intermediate guideline member 12 is formed to surround the shape of the golf hole 24. Even more preferably, each of the first and second guideline members 14 and 16 should be integrally formed with the intermediate guideline member 12. However, it is anticipated that each of the first and second guideline members 14 and 16 may be detachably engageable to the intermediate guideline member 12 and extendable therefrom.

To further provide rigidity to the body 10, a support ridge 40 may formed. More specifically, at least one of the first and second substantially planar surfaces 32 and 34 may define the support ridge 40. Preferably, the support ridge 40 extends perpendicularly with respect to the first and second planar surfaces 32 and 34. Even more preferably, each of the first and second planar surfaces 32 and 34 may define its own respective support ridge 40 to extend perpendicularly therefrom. The support ridge 40 formed on such portions of the body 10 provide enhanced rigidity such that inadvertent bending or flexion of the body 10 could be resisted due to the thickness of the support ridge 40.

Additionally, the support ridge 40 also functions as the point of engagement between the body 10 and a surface, i.e. golf putting green. By providing a support ridge 40 on both the first and second planar surfaces 32 and 34, the body 10 may be flippable between the first and second planar surfaces 32 and 34 so as to be selectively placed adjacent a grass surface. For example, if the body 10 is placed adjacent the golf hole 24 such that the first planar surface 32 is adjacent the grass surface of the green, the body 10 may be flipped such that the second planar surface 34 is placed adjacent the green. Such a configuration is advantageous in that the line of travel 18 to the golf hole 24 and the point of entry 54 frequently change direction based upon the slope angle $\alpha$ of the green. By allowing a golfer 22 to flip the device over and place the body 10 adjacent the golf hole 24, the device may be applied in virtually all types of positions and slope angles $\alpha$. Additionally, the support ridge 40 is preferably formed continuously about outer and inner portions 42 and 44 of at least one of the first and second substantially planar surfaces 32 and 34. Such a configuration ensures enhanced rigidity to the body 10 whereby bending of the body could be resisted by the support ridge 40 formed about the outer and inner portions 42 and 44. However, it is anticipated that the support ridge 40 can be formed throughout other portions of the body 10 to prevent disformation in shape to the body 10 and breakage caused by excessive pressure applied to the body. For example, the support ridge 40 may be formed lengthwise along the body 10 so resist bending and flexion of the same.

Figures 5, 6, 7, 8:
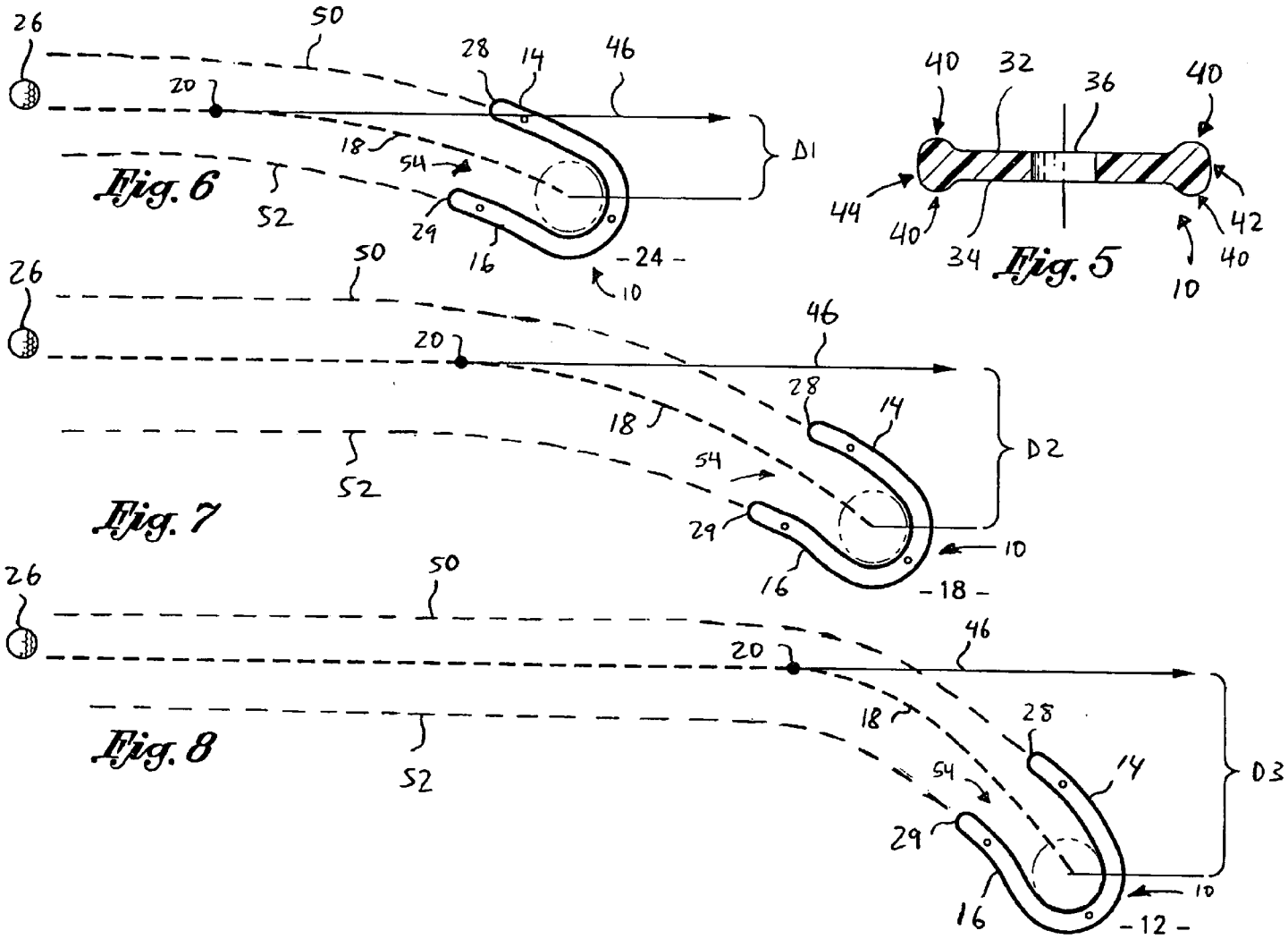
FIG. 5 is a cross-sectional view of the instructional device taken along 5—5 in FIG. 4.
FIG. 6 is a plan view of a first embodiment of the present invention taken along 6—6 in FIG. 1 and illustrates placement of the device adjacent a golf hole so as to allow the golfer to visualize the point of entry and the breaking point.
FIG. 7 is a plan view of a second embodiment of the present invention illustrating placement of the device adjacent a golf hole so as to allow the golfer to visualize the point of entry and the breaking point.
FIG. 8 is a plan view of a third embodiment of the present invention illustrating placement of the device adjacent a golf hole so as to allow the golfer to visualize the point of entry and the breaking point.

As shown in FIG. 5, the body 10 may be formed having first and second substantially planar surfaces 32 and 34 facially opposing each other. Preferably, the first and second planar surfaces 32 and 34 of the body 10 extend continuously throughout the body along the first and second guideline members 14 and 16, and the intermediate guideline member 12. Thus, the first and second guideline members 14 and 16 integrally formed with the intermediate guideline member 12 may collectively form the first and second planar surfaces 32 and 34. As shown in FIGS. 2–4, the body 10 may define a plurality of apertures 36. Each of these apertures 36 may be formed between the first and second planar surfaces 32 and 34 for receiving a mounting member 38 therethrough. Preferably, the apertures 36 are sized and configured to receive the mounting member 38, which is preferably a golf tee. Even more preferably, the apertures 36 are circular in shape. As illustrated in FIG. 1, the mounting members 38 may be inserted through the apertures 36 to secure the body 10 to a surface adjacent the golf hole 24. Advantageously, securing the body 10 prevents the body 10 from flying away or otherwise shifting position due to wind which is frequently experienced on a golf course. Preferably, at least one aperture 36 should be formed in the intermediate guideline member 12 while at least one aperture 36 should be formed in either the first or second guideline member 14 and 16, or both. By forming the apertures 36 on these portions of the body 10, the body 10 may be properly secured to a surface, i.e. golf green, so as to prevent rotation of the body 10 on the surface.

As shown in FIGS. 2–4, the present invention may include at least three embodiments. Each of the first and second guideline members 14 and 16 have a respective curved portion 30 substantially corresponding to the line of travel 18 and defining the point of entry 54 therebetween. As shown in FIGS. 2 and 6, a first embodiment of the present invention is illustrated whereby each of the respective curved portions 30 are defined by a circle of curvature having a radius of 12 inches. Similarly, as shown in FIGS. 3 and 7, a second embodiment of the present invention is illustrated whereby each of the respective curved portions 30 are defined by a circle of curvature having a radius of approximately 18 inches. Additionally, FIGS. 4 and 8 also depict a third embodiment of the present invention whereby each of the respective curved portions 30 are defined by a circle of curvature having a radius of approximately 24 inches. In fabricating the body 10, a circle is drawn adjacent the curved portion 30 such that the curved portion 30 is measured by an arc of the circle drawn adjacent thereto. One of these three embodiments shown in FIGS. 2–4 are designed to be selected by the golfer 22 depending upon the slope angle $\alpha$, and the respective distances D1, D2, and D3 between the golf hole 24 and the target line 46. Thus, it is the severity of the break, or relative curvature of the line of travel 18 which dictates whether to select a 12, 18, or 24 inch radius curved portion 30. Generally, the 24 inch radius body 10 should be selected for relatively minor breaks due to its substantially straight first and second guideline members 14 and 16. The 18 inch radius body 10 is selected for breaks which are moderate while the 12 inch radius body 10 should be selected for severe breaks where it is generally most difficult to estimate the target line 46, breaking point 20, and line of travel 18.

In positioning the body 10 adjacent the golf hole 24, rotation of the body 10 is determined by measuring the angle between the golf ball 26 and the golf hole 24, and measuring the distance between a center portion of the golf hole 24 and the target line 46.

Advantageously, by positioning the body 10 adjacent the golf hole 24, the golfer 22 is assisted by visualizing the line of travel 18 and the ultimate point of entry 54. To accomplish this, the body 10 is preferably positioned adjacent the golf hole 24 and rotated thereabout into a fixed position so that the first and second guideline members 14 and 16 may collectively define the first and second boundaries 50 and 52 for the point of entry 54 therebetween and identify the breaking point 20. Essentially, it is the first and second guideline members 14 and 16 which provide reference points for which the golfer 22 may understand that how much speed and angle is necessary to allow the golf ball to fall within the boundaries and ultimately enter the point of entry 54 to the hole 24. To further assist in this visualization process for the golfer 22, the first and second guideline members 14 and 16 preferably have first and second distal end portions respectively 28 and 29 for pointing the first and second guideline members 14 and 16 toward the breaking point 20 and for further defining the point of entry 54. Such distal end portions 28 and 29 allow the golfer 22 to understand where at least a portion of the first and second boundaries 50 and 52 should begin. Preferably, the second distal end portion 29 extends away from the first distal end portion 28. While the first and second distal end portions 28 and 29 may ultimately point toward the same general direction, the term "extends away" is intended to refer to the first distal end portion's 28 curved configuration which is formed to point in a direction away from the first distal end. Thus, the second distal end portion 29 should at no time point toward the first distal end portion 28 or the first guideline member 14.

Additional modifications and improvements of the present invention may also be apparent to those of ordinary skill in the art. Thus, the particular combination of parts described and illustrated herein is not intended to serve as limitations of alternative devices within the spirit and scope of the invention.

What is claimed is:

1. A method of assisting a golfer to putt/chip a golf ball to a golf hole, the method comprising the steps of:

a) selecting a golf instructional device having:

a substantially rigid body formed to visually identify a point of entry adjacent the golf hole and a breaking point on a line of travel, the body defining:

an intermediate guideline member having a generally u-shaped configuration formed to surround at least a portion of the golf hole, an elongated first guideline member extending from a portion of the intermediate guideline member, the first guideline member defining a first boundary for the point of entry; and an elongated second guideline member extending from a portion of the intermediate guideline member, the second guideline member defining a second boundary for the point of entry; and b) positioning at least a portion of the intermediate guideline member adjacent the golf hole;

c) rotating the golf instructional device about the golf hole to define the point of entry; and d) aligning the first and second guideline members with the breaking point on the line of travel.

2. The method as in claim 1 wherein the first and second guideline members are formed having first and second distal end portions respectively, and step b) further comprises the step of pointing the first and second guideline members toward the breaking point.

3. The method as in claim 2 wherein the second distal end portion extends away from the first distal end portion.

4. The method as in claim 1 wherein each of the first and second guideline members have a respective curved portion substantially corresponding to the line of travel.

5. The method as in claim 4 wherein each of the respective curved portions are defined by a circle of curvature having a radius of 12 inches.

6. The method as in claim 4 wherein each of the respective curved portions are defined by a circle of curvature having a radius of 18 inches.

7. The method as in claim 4 wherein each of the respective curved portions are defined by a circle of curvature having a radius of 24 inches.

8. The method as in claim 1 wherein each of the first and second guidelines are integrally formed with the intermediate guideline member.

9. The method as in claim 1 wherein the body is formed having first and second substantially planar surfaces facially opposing each other.

10. The method as in claim 9 wherein the body defines a plurality of apertures, each of the apertures being formed between the first and second planar surfaces to receive a mounting member therethrough, and step b) further comprises the step of:

inserting at least one mounting through one of the apertures so as to secure the body to a surface adjacent the golf hole.

11. The method as in claim 10 wherein the mounting member is a golf tee.

12. The method as in claim 9 wherein at least one of the first and second substantially planar surfaces further defines a support ridge extending perpendicularly therefrom.

13. The method as in claim 12 wherein the support ridge is continuously formed about outer and inner portions of at least one of the first and second substantially planar surfaces.

14. The method as in claim 13 wherein step b) further comprises the step of:

placing one of the first and second planar surfaces adjacent a grass surface.

15. The method as in claim 1 wherein step b) further comprises the steps of:

measuring approximate slope angle of a grass surface between the golf ball and the golf hole;

measuring approximate distance between the golf hole and the golfers; and identifying the point of entry and the breaking point relative to the slope angle.

16. The method as in claim 1 further comprising the step of:

e) putting the golf ball along the target line while adjusting swing speed to allow a golf ball to further travel along the line of travel toward the golf hole.

17. A golf instructional device for assisting a golfer to putt/chip a golf ball to a golf hole, the device comprising:

a substantially rigid body formed to visually identify a point of entry adjacent the golf hole and a breaking point on a line of travel, the body defining:

an intermediate guideline member having a generally u-shaped configuration formed to surround at least a portion of the golf hole;

an elongated first guideline member extending from a portion of the intermediate guideline member, the first guideline member defining a first boundary for the point of entry of having a curved portion substantially corresponding to the line of travel;

an elongated second guideline member extending from a portion of the intermediate guideline member, the second guideline member defining a second boundary for the point of entry and having a curved portion substantially corresponding to the line of travel; and wherein at least a portion of the intermediate guideline member is positionable adjacent the golf hole and rotatable thereabout such that the first and second guideline members collectively define the first and second boundaries for the point of entry therebetween and further identify the breaking point.

18. The golf instructional device as in claim 17 wherein each of the respective curved portions are defined by a circle of curvature having a radius of 12 inches.

19. The golf instructional device as in claim 17 wherein each of the respective curved portions are defined by a circle of curvature having a radius of 18 inches.

20. The golf instructional device as in claim 17 wherein each of the respective curved portions are defined by a circle of curvature having a radius of 24 inches.

21. A golf instructional device for assisting a golfer to putt/chip a golf ball to a golf hole, the device comprising:

a substantially rigid body formed to visually identify a point of entry adjacent the golf hole and a breaking point on a line of travel, the body having first and second substantially planar surfaces facially opposing each other, at least one of the first and second planar surfaces further defining a support ridge extending perpendicularly therefrom, the body defining:

an intermediate guideline member having a generally u-shaped configuration formed to surround at least a portion of the golf hole;

an elongated first guideline member extending from a portion of the intermediate guideline member, the first guideline member defining a first boundary for the point of entry;

an elongated second guideline member extending from a portion of the intermediate guideline member, the second guideline member defining a second boundary for the point of entry; and wherein at least a portion of the intermediate guideline member is positionable adjacent the golf hole and rotatable thereabout such that the first and second guideline members collectively define the first and second boundaries for the point of entry therebetween and further identify the breaking point; and the support ridge is continuously formed about outer and inner portions of at least one of the first and second substantially planar surfaces.

* * * * *